US011352203B2

(12) United States Patent
Anderson

(10) Patent No.: US 11,352,203 B2
(45) Date of Patent: Jun. 7, 2022

(54) THIEF HATCH ASSEMBLY WITH IMPROVED SEAL

(71) Applicant: Jess D. Anderson, Gillette, WY (US)

(72) Inventor: Jess D. Anderson, Gillette, WY (US)

( * ) Notice: Subject to any disclaimer, the term of this patent is extended or adjusted under 35 U.S.C. 154(b) by 96 days.

(21) Appl. No.: 16/559,573

(22) Filed: Sep. 3, 2019

(65) Prior Publication Data

US 2021/0061553 A1 Mar. 4, 2021

(51) Int. Cl.

| | |
|---|---|
| ***B65D 90/34*** | (2006.01) |
| ***B65D 90/10*** | (2006.01) |
| ***B65D 47/32*** | (2006.01) |

(52) U.S. Cl.
CPC ..... *B65D 90/34* (2013.01); *B65D 47/32* (2013.01); *B65D 90/10* (2013.01)

(58) Field of Classification Search
CPC ..... B65D 90/34; B65D 47/32; B65D 90/10
See application file for complete search history.

(56) References Cited

U.S. PATENT DOCUMENTS

| | | | | |
|---|---|---|---|---|
| 5,718,460 | A | 2/1998 | Glunt | |
| 2007/0114039 | A1* | 5/2007 | Hobdy | E21B 33/03 166/379 |
| 2018/0274284 | A1* | 9/2018 | Bartha | B65D 90/34 |

OTHER PUBLICATIONS

"Series 3908, Pressure & Vacuum Relief Thief Hatch", Brochure, The Protectoseal Company, Bensenville, IL, 2019.
"Jayco Thief Hatch, Peak 1", Brochure, Jay Courtney Company, Inc., Oklahoma City, OK, 2019.
"Model ES-660 and ES-660-L, Brochure, Thief Hatches", ENARDO Hatches, Tulsa, OK, 2019.

* cited by examiner

*Primary Examiner* — Shawn M Braden
(74) *Attorney, Agent, or Firm* — Jeffrey L. Thompson; Thompson Law, P.A.

(57) ABSTRACT

A thief hatch assembly for a storage tank includes a housing and a cover that rests on an upper surface of the housing to seal and maintain a pressure within the storage tank. The thief hatch cover is configured to open at a predetermined set pressure to relieve excess pressure from the storage tank. The thief hatch assembly is attached to the storage tank using blind threaded mounting holes to prevent escape of gases from the storage tank through the mounting holes. In one embodiment, the blind threaded holes are provided in a flange adapter that mounts between the thief hatch housing and the storage tank. In another embodiment, the blind threaded holes are provided in a flange adapter that is welded to the storage tank. In another embodiment, the blind threaded holes are provided in the base of the thief hatch housing. Seals are provided between the mounting surfaces.

8 Claims, 7 Drawing Sheets

Fig. 3
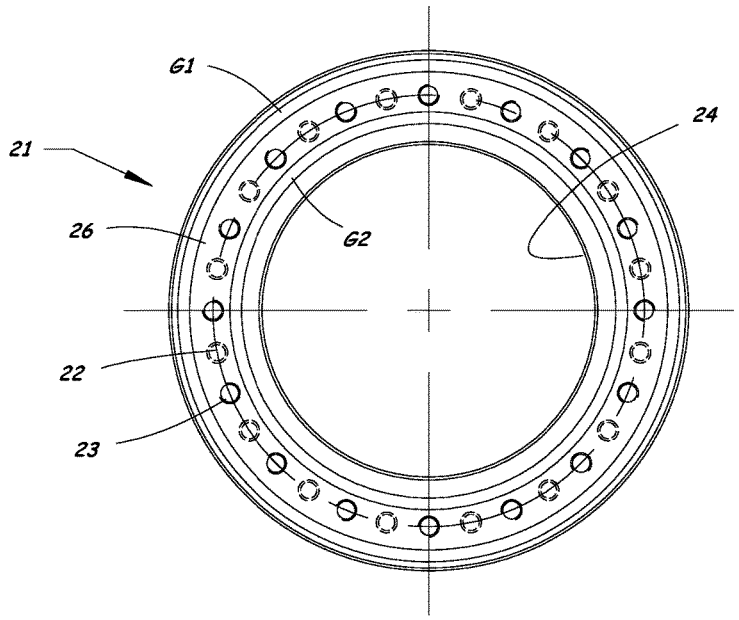
Fig. 5
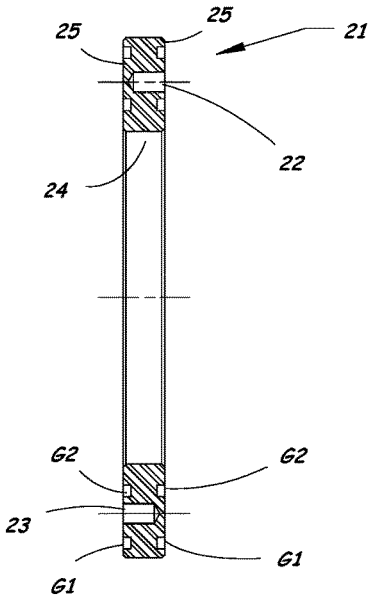
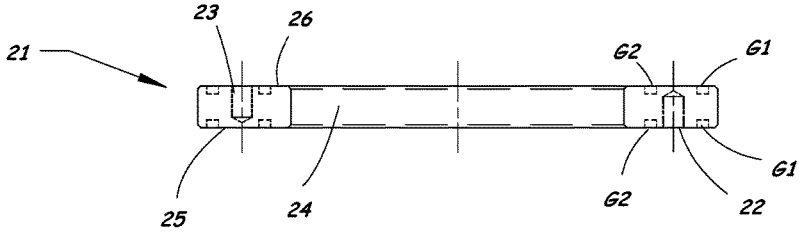
Fig. 4

Fig. 8
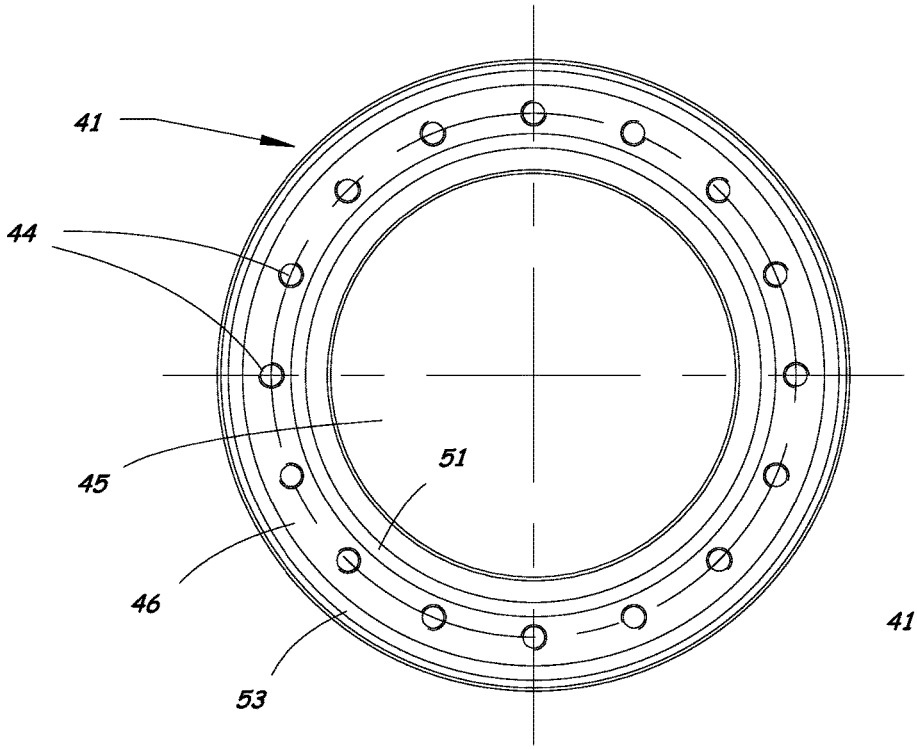
Fig. 10
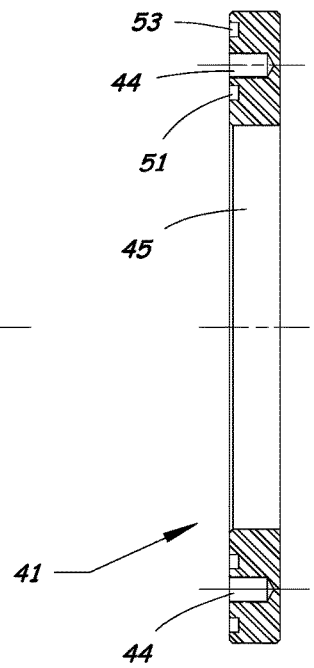
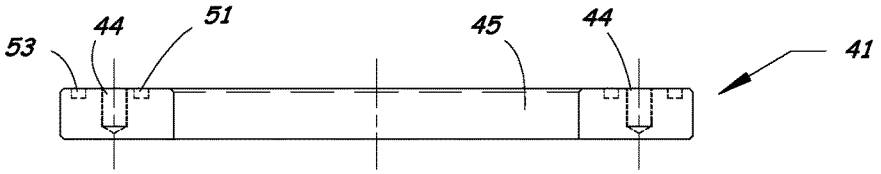
Fig. 9

THIEF HATCH ASSEMBLY WITH IMPROVED SEAL

BACKGROUND OF THE INVENTION

Field of the Invention

The present invention relates generally to thief hatches for storage tanks, and in particular, to thief hatches with seals to minimizing the escape of gases from storage tanks.

Description of the Related Art

Thief hatches have long been attached to the top of production tanks in oilfields. Production tanks are typically large upright storage tanks used to store both crude oil and produced water on an oilfield location. Thief hatches provide access to the tanks for sampling and gauging purposes, and also provide both a pressure relief and a vacuum relief to accommodate changing fluid levels in the tank and temperature changes throughout the day.

The conventional manner of attaching thief hatches to tanks is to use bolts that extend through holes in a mounting flange on the thief hatch and holes in the top of the tank. In a standard API arrangement, the tank manufacturer will cut an 8 inch diameter hole in the top of the tank and 16 mounting holes on a 10 inch bolt pattern surrounding the 8 inch hole. The thief hatch is then bolted directly to the storage tank. This attachment was typically made with a simple rubber gasket (e.g., a Viton or Buna gasket) between the thief hatch and the tank, and 16 half inch diameter bolts extending through the mounting holes with threaded nuts to secure the assembly.

Environmental concerns have led to close monitoring of petroleum vapors leaking from thief hatches. Government agencies have set minimum standards for petroleum vapor leakage, and in some cases have levied fines on operators not in compliance.

Infrared sensors are used to detect vapor leaks and to pin point the source of the leaks. The seal on the lid of the thief hatch is one issue, but another problem area has been gas vapors that leak to the outside around some or all of the bolts attaching the thief hatch to the tank. Attempts have been made to minimize the leaks by using rubber gaskets and by attempting to perfect the seal between the thief hatch and the tank, particularly in the area of the bolts.

However, there remains a need for a better solution to this problem.

SUMMARY OF THE INVENTION

An object of the present invention is to provide a thief hatch assembly for a storage tank that prevents escape of gases from the storage tank through the mounting holes.

A further object of the present invention is to provide an improved mounting arrangement for a thief hatch assembly that can be used with existing storage tanks.

A further object of the present invention is to provide an flange adapter for a thief hatch assembly that is inexpensive to manufacture, easy to install, universal to fit a variety of thief hatch and storage tank designs, and effective in operation to prevent escape of gases from storage tanks through the mounting holes.

A further object of the present invention is to provide a variety of thief hatch mounting options that can be used with existing thief hatches, existing storage tanks, and/or new thief hatch configurations to prevent escape of gases from the storage tanks through the mounting holes.

These and other objects of the present invention are accomplished by a thief hatch assembly for a storage tank that includes a housing and a cover that rests on an upper surface of the housing to seal and maintain a pressure within the storage tank. The thief hatch cover is configured to open at a predetermined set pressure to relieve excess pressure from the storage tank. The thief hatch assembly is attached to the storage tank using blind threaded mounting holes to prevent escape of gases from the storage tank through the mounting holes. In one embodiment, the blind threaded holes are provided in a flange adapter that mounts between the thief hatch housing and the storage tank. In another embodiment, the blind threaded holes are provided in a flange adapter that is welded to the storage tank. In another embodiment, the blind threaded holes are provided in the base of the thief hatch housing. Seals are provided between the mounting surfaces to prevent escape of gases from the storage tank.

According to one embodiment of the present invention, a combination of a storage tank having an access opening and a thief hatch assembly mounted over the access opening is provided, comprising: a plurality of through holes spaced around the access opening in the storage tank; and a flange adapter having a central opening, a bottom side and a top side, a first group of blind threaded holes formed in the flange adapter that are open to the bottom side, and a second group of blind threaded holes formed in the flange adapter that are open to the top side. The flange adapter is positioned on the storage tank with the first group of blind threaded holes in the bottom side of the flange adapter aligned with the holes in the storage tank, and a first group of threaded fasteners extending through the holes in the storage tank into threaded engagement with the first group of blind threaded holes in the flange adapter. A thief hatch housing with a base flange is positioned on the top side of the flange adapter. The base flange has a plurality of through holes that align with the second group of blind threaded holes in the flange adapter, and a second group of threaded fasteners extend through the holes in the base flange into threaded engagement with the second group of blind threaded holes in the flange adapter.

According to another embodiment of the present invention, a thief hatch assembly for a storage tank is provided, comprising: a thief hatch housing; a thief hatch cover that rests on an upper surface of the thief hatch housing to seal and maintain a pressure within the storage tank, the thief hatch cover being configured to open at a predetermined set pressure to relieve excess pressure from the storage tank; and a means for attaching the thief hatch housing to the storage tank using blind threaded mounting holes to prevent escape of gases from the storage tank through the mounting holes.

Numerous other objects of the present invention will be apparent to those skilled in this art from the following description wherein there is shown and described embodiments of the present invention, simply by way of illustration of some of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the present invention is made with reference to the accompanying drawings. In the drawings:

FIG. 3 is a plan view of the flange adapter shown in FIG. 2.

FIG. 4 is a side view of the flange adapter.

FIG. 5 is a cross section view of the flange adapter.

FIG. 8 is a plan view of the weld-on flange adapter shown in FIG. 2.

FIG. 9 is a side view of the weld-on flange adapter.

FIG. 10 is a cross section view of the weld-on flange adapter.

DETAILED DESCRIPTION OF THE INVENTION

Figure 1:
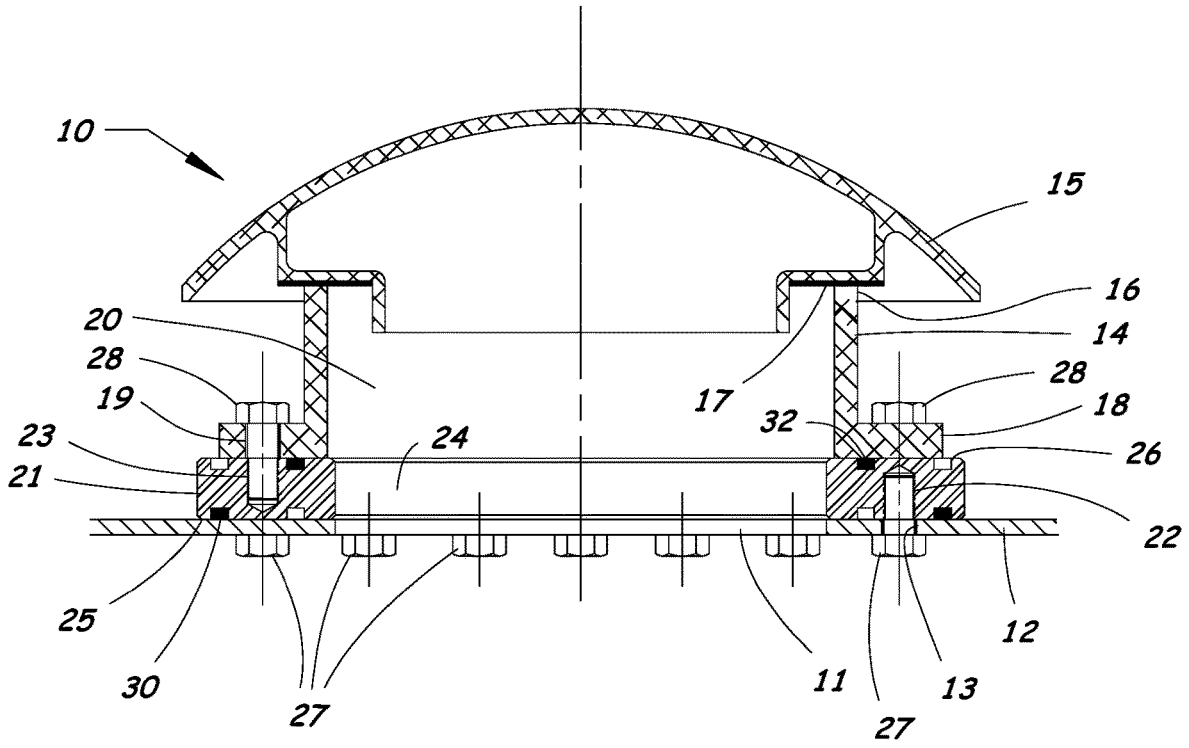
FIG. 1 is a cross section elevation view of a thief hatch assembly according to a first embodiment of the invention, in which a flange adapter with blind mounting holes is used to secure the thief hatch assembly to a storage tank.
Figure 2:
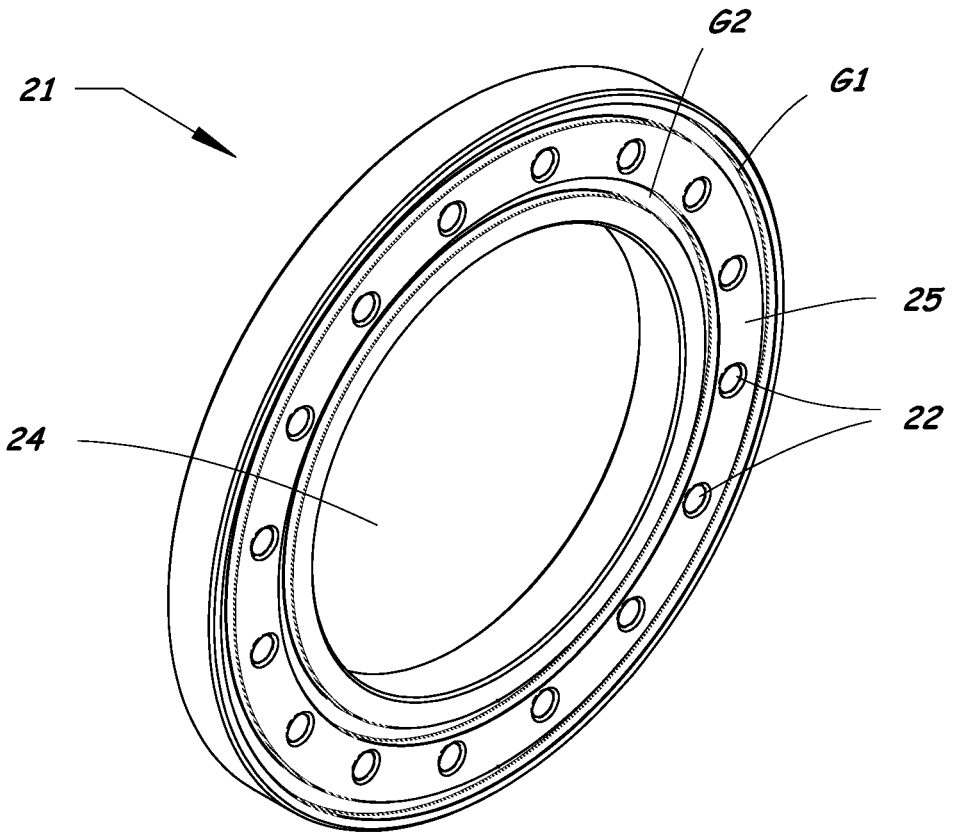
FIG. 2 is a perspective view of the flange adapter from the thief hatch assembly shown in FIG. 1.
Figure 6:
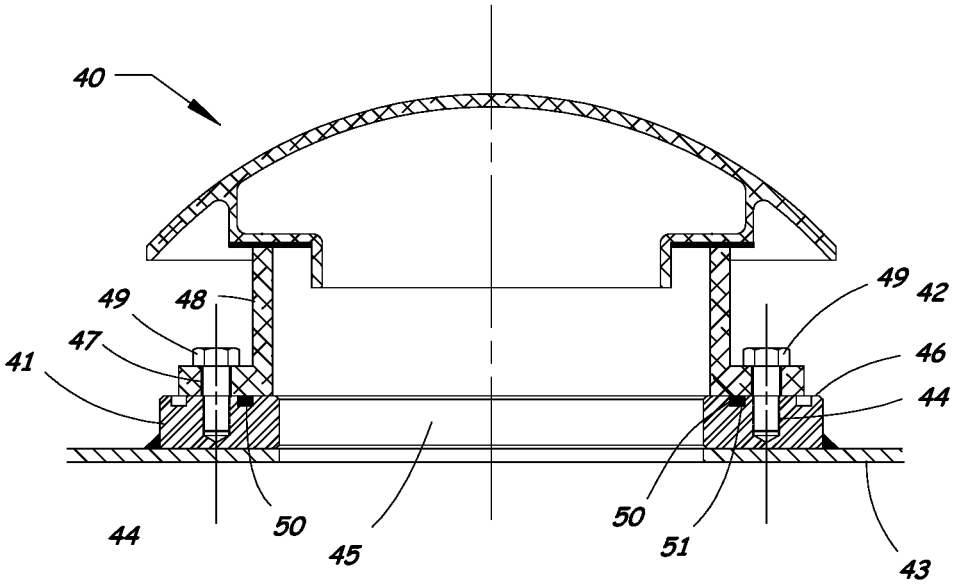
FIG. 6 is a cross section elevation view of a thief hatch assembly according to a second embodiment of the invention, in which a flange adapter with blind mounting holes is welded to the storage tank.
Figure 7:
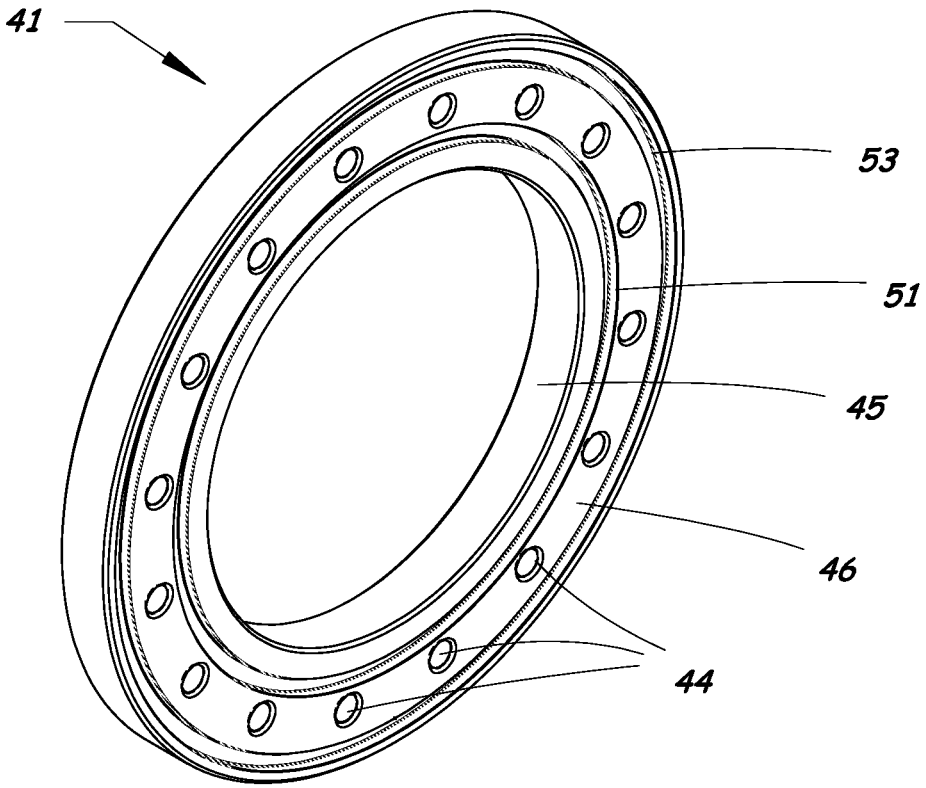
FIG. 7 is a perspective view of the weld-on flange adapter from the thief hatch assembly shown in FIG. 6.

A thief hatch assembly according to the present invention will be described in detail below with reference to FIGS. 1 to 11 of the accompanying drawings.

A thief hatch assembly 10 according to a first embodiment of the present invention will be described with reference to FIGS. 1 to 5. The thief hatch assembly 10 is mounted over an access opening 11 on a top side of a storage tank 12. The access opening 11 in the storage tank 12 can be, for example, an API standard access opening having an 8-inch diameter central opening and a pattern of 16 mounting holes 13 surrounding the central opening. The mounting holes 13 can be arranged in a 10-inch diameter circular pattern around the central opening. The mounting holes 13 extend through the top wall of the storage tank 12.

The thief hatch assembly 10 includes a thief hatch housing 14 and a thief hatch cover 15 that rests on an upper surface 16 of the thief hatch housing 14. A cover seal 17 is provided at the interface between the thief hatch cover 15 and the upper surface 16 of the thief hatch housing 14. The thief hatch cover 15 is configured to open at a predetermined set pressure to relieve excess pressure from the storage tank 12 to accommodate changing fluid levels and temperature changes in the storage tank 12. A vacuum relief (not shown) can also be provided in the thief hatch assembly 10 to provide a secondary vent for the storage tank 12.

The thief hatch housing 14 has a base flange 18 with a plurality of mounting holes 19 arranged around a central opening 20. For example, the mounting holes 19 in the base flange 18 can have the same pattern of 16 mounting holes in a 10-inch diameter circular pattern surrounding an 8-inch diameter central opening 20 to correspond with a common API standard for storage tank access openings.

A flange adapter 21 provides a means for attaching the thief hatch housing 14 to the storage tank 12 using blind threaded mounting holes 22, 23. The blind threaded mounting holes 22, 23 are offset from one another on each side of the flange adapter 21 and are not drilled completely through the flange adapter 21. By using blind threaded mounting holes 22, 23 instead of through holes to attach the thief hatch housing 14 to the storage tank 12, gases can be prevented from escaping from the storage tank 12 through the mounting holes 22, 23.

The flange adapter 21 has a central opening 24, a bottom side 25, a top side 26, a first group of blind threaded holes 22 that are open to the bottom side 25, and a second group of blind threaded holes 23 that are open to the top side 26. The blind threaded holes 22, 23 are tapped/threaded (e.g., ½" diameter NC threads) and arranged so that the flange adapter 21 can be bolted to the storage tank 12 from one side, and the thief hatch assembly 10 can be bolted to the flange adapter 21 from the other side. In this way, there can be no communication of vapor through a bolt hole from one side to the other.

The flange adapter 21 is positioned on the storage tank 12 with the first group of blind threaded holes 22 in the bottom side 25 of the flange adapter 21 aligned with through holes 13 in the storage tank 12. A first group of threaded fasteners 27 (e.g., ½ inch diameter bolts) extend through the holes 13 in the storage tank 12 into threaded engagement with the first group of blind threaded holes 22 in the flange adapter 21. The flange adapter 21 is thus secured to the storage tank 12 without using mounting holes that extend all the way through the flange adapter 21.

The base flange 18 of the thief hatch housing 14 is positioned on the top side 26 of the flange adapter 21. The base flange 18 has a plurality of through holes 19 that align with the second group of blind threaded holes 23 in the flange adapter 21. A second group of threaded fasteners 28 (e.g., ½ inch diameter bolts) extend through the holes 19 in the base flange 18 into threaded engagement with the second group of blind threaded holes 23 in the flange adapter 21. The base flange 18 is thus secured to the flange adapter 21 without using mounting holes that extend all the way through the flange adapter 21.

A first groove G1 is formed in the bottom side 25 of the flange adapter 21, and a first seal ring 30 is positioned in the first groove G1. The first seal ring 30 is arranged to form a seal between the storage tank 12 and the bottom side 25 of the flange adapter 21 radially outward of the through holes 13 in the storage tank 12 and the first group of blind holes 22 in the flange adapter 21.

A second groove G2 is formed in the top side 26 of the flange adapter 21, and a second seal ring 32 is positioned in the second groove G2. The second seal ring 32 is arranged to form a seal between the flange adapter 21 and the bottom surface 33 of the thief hatch housing 14 radially inward of the through holes 19 in the base flange 18 and the second group of blind holes 23 in the flange adapter 21.

The first and second seal rings 30, 32 can be, for example, rubber seal rings with rectangular (e.g., ¼ inch square) cross sections to fit within the first and second grooves G1, G2, respectively.

The flange adapter 21 can be made with the bottom and top sides 25, 26 substantially the same so that the flange adapter 21 can be positioned with either side facing up. Thus, a first pair of annular grooves G1, G2 are formed in the bottom side 25 of the flange adapter 21, and a second pair of annular grooves G1, G2 are formed in top side 26 of the flange adapter 21. Each of the first and second pairs of annular grooves G1, G2 includes an outer groove G1 located radially outward of the blind holes 22, and an inner groove G2 located radially inward of the blind holes 23. By providing the flange adapter 21 with a pair of annular grooves on both sides, the flange adapter 21 is nondirectional in installation.

The first seal ring 30 is configured to fit into one of the outer grooves G1 for providing a seal between the storage tank 12 and the flange adapter 21. The second seal ring 32 is configured to fit into the inner groove G2 on the opposite side of the flange adapter 21 from the first seal ring 30 for providing a seal between the flange adapter 21 and the base flange 18 of the thief hatch housing 14. By positioning the first and second seal rings 30, 32 in the outer and inner grooves G1, G2, respectively, an effective seal can be provided to prevent escape of gases from the storage tank 12 through the mounting holes. Additional seal rings (not shown) can be placed in the other grooves on the flange adapter, if desired, but would generally not be necessary.

The flange adapter 21 can be produced from many different materials and can be used with various other types of gaskets and seals. For example, a conventional flat rubber gasket can be used on each side of the adapter 21, instead of seal rings 30, 32 that fit into grooves G1, G2. The blind drilled and tapped mounting holes 22, 23 on each side of the flange adapter 21 is what allows to adapter 21 to provide a positive and effective seal with conventional gaskets without vapor leakage through the mounting holes 22, 23.

The concepts disclosed herein could also be used to mount a fixture other than a thief hatch to a tank with a compatible bolt pattern. For example, the flange adapter 21 can be used to mount any fixture to a tank with a compatible bolt pattern using a flat gasket with aligned bolt holes to eliminate communication of vapor through the bolt holes.

A thief hatch assembly 40 according to a second embodiment of the present invention will be described with reference to FIGS. 6 to 10. In this embodiment, a weld-on flange adapter 41 is used to provide a means for attaching the thief hatch housing 42 to a storage tank 43 using blind threaded mounting holes 44 to prevent escape of gases from the storage tank 43 through the mounting holes 44.

The flange adapter 41 is welded to the storage tank 43 to secure the flange adapter 41 and to seal against any leakage between the flange adapter 41 and the storage tank 43. The weld-on flange adapter 41 has a central opening 45, a top side 46, and a group of blind threaded holes 44 formed in the flange adapter 41 that are open to the top side 46. The blind threaded holes 44 are aligned with through holes 47 in the base flange 48 of the thief hatch housing 42. A plurality of threaded fasteners 49 extend through the holes 47 in the base flange 48 into threaded engagement with the blind threaded holes 44 in the flange adapter 41.

A seal member 50, such as a rubber seal ring, is received in an inner groove 51 on a top side of the flange adapter 41. The seal member 50 is positioned between the top side 46 of the flange adapter 41 and a bottom surface 52 of the base flange 48 to form a seal between the flange adapter 41 and the thief hatch housing 42 radially inward of the holes 47 in the base flange 48. By positioning the seal member 50 radially inward of the holes 47 in the base flange 48, an effective seal can be provided to prevent escape of gases from the storage tank 43 through the mounting holes. An additional seal ring (not shown) can be placed in the outer groove 53 on the weld-on flange adapter 41, if desired, but would generally not be necessary.

Figure 11:
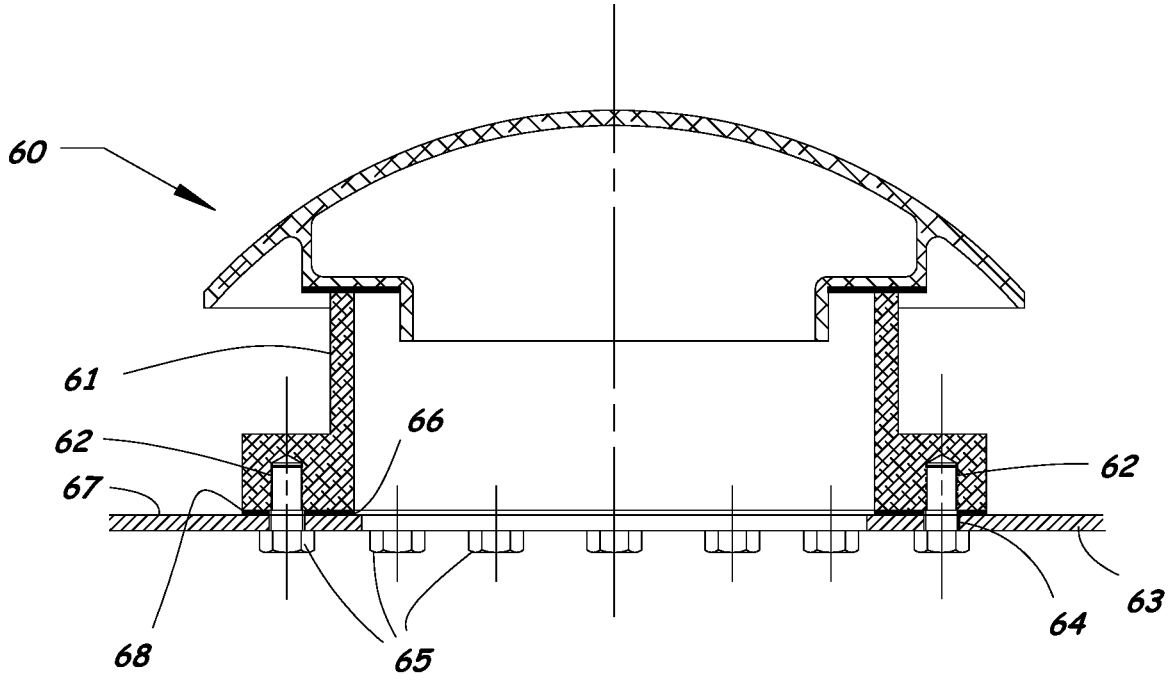
FIG. 11 is a cross section elevation view of a thief hatch assembly according to a third embodiment of the invention, in which blind mounting holes are provided in a housing of the thief hatch assembly.

A thief hatch assembly 60 according to a third embodiment of the invention will be described with reference to FIG. 11. In this embodiment, a thief hatch housing 61 with blind mounting holes 62 is used to provide a means for attaching the thief hatch housing 61 to a storage tank 63 without allowing gases to escape through the mounting holes 62.

The blind mounting holes 62 in the thief hatch housing 61 open downwardly and are aligned with a plurality of through holes 64 in the storage tank 63. A plurality of threaded fasteners 65 (e.g., ½ inch diameter bolts) extend through the holes 64 in the storage tank 63 into threaded engagement with the blind threaded holes 62 in the thief hatch housing 61.

A seal member 66 is positioned between a top side 67 of the storage tank 63 and a bottom surface 68 of the thief hatch housing 61. The seal member 66 provides a seal between the top side 67 of the storage tank 63 and the thief hatch housing 61 radially outward of the through holes 64 in the storage tank 63. The seal member 66 can be in the form of a seal gasket that covers the bottom surface of the thief hatch housing 61, as shown in FIG. 11. Alternatively, the seal member 66 can be a seal ring that fits within a groove (not shown) in the bottom of the thief hatch housing 61 located radially outward of the through holes 64 in the storage tank 63.

While the invention has been described in connection with specific embodiments thereof, it is to be understood that this is by way of illustration and not of limitation, and the scope of the appended claims should be construed as broadly as the prior art will permit.

What is claimed is:

1. In combination, a storage tank having an access opening and a thief hatch assembly mounted over said access opening, comprising:

said storage tank having a plurality of through holes spaced around the access opening;

a flange adapter having a central opening, a bottom side and a top side, a first group of blind threaded holes formed in the flange adapter that are open to the bottom side, and a second group of blind threaded holes formed in the flange adapter that are open to the top side;

said flange adapter being positioned on said storage tank with the first group of blind threaded holes in the bottom side of the flange adapter aligned with the holes in the storage tank, and a first group of threaded fasteners extending through the holes in the storage tank into threaded engagement with the first group of blind threaded holes in the flange adapter; and a thief hatch housing with a base flange positioned on the top side of said flange adapter, said base flange having a plurality of through holes that align with the second group of blind threaded holes in said flange adapter, and a second group of threaded fasteners extending through the holes in the base flange into threaded engagement with the second group of blind threaded holes in the flange adapter;

further comprising a first seal ring positioned between a top surface of said storage tank and the bottom side of said flange adapter;

wherein said first seal ring is arranged to form a seal between said storage tank and said flange adapter radially outward of the through holes in the storage tank and the first group of blind holes in the flange adapter;

further comprising a second seal ring positioned between the top side of said flange adapter and a bottom surface of the base flange of the thief hatch housing;

wherein said second seal ring is arranged to form a seal between said flange adapter and said base flange radially inward of the through holes in the base flange and the second group of blind holes in the flange adapter; and wherein said flange adapter comprises a first annular groove formed in said bottom side for receiving said first seal ring, said first groove being located radially outward of said first group of blind holes.

2. The combination according to claim 1, wherein said flange adapter comprises a second annular groove formed in said top side for receiving said second seal ring, said second groove being located radially inward of said second group of blind holes.

3. The combination according to claim 2, wherein said thief hatch assembly further comprises a thief hatch cover that rests on an upper surface of said thief hatch housing to seal and maintain a pressure within said tank.

4. In combination, a storage tank having an access opening and a thief hatch assembly mounted over said access opening, comprising:

said storage tank having a plurality of through holes spaced around the access opening;

a flange adapter having a central opening, a bottom side and a top side, a first group of blind threaded holes formed in the flange adapter that are open to the bottom side, and a second group of blind threaded holes formed in the flange adapter that are open to the top side;

said flange adapter being positioned on said storage tank with the first group of blind threaded holes in the bottom side of the flange adapter aligned with the holes in the storage tank, and a first group of threaded fasteners extending through the holes in the storage tank into threaded engagement with the first group of blind threaded holes in the flange adapter; and a thief hatch housing with a base flange positioned on the top side of said flange adapter, said base flange having a plurality of through holes that align with the second group of blind threaded holes in said flange adapter, and a second group of threaded fasteners extending through the holes in the base flange into threaded engagement with the second group of blind threaded holes in the flange adapter;

wherein said flange adapter comprises a first annular groove formed in said bottom side and a first seal ring received in said first annular groove to provide a seal between said storage tank and said flange adapter, said first groove being located radially outward of said first group of blind holes.

5. The combination according to claim 4, wherein said flange adapter comprises a second annular groove formed in said top side and a second seal ring received in said second annular groove to provide a seal between said flange adapter and said base flange of the thief hatch housing, said second groove being located radially inward of said second group of blind holes.

6. The combination according to claim 4, wherein the bottom and top sides of said flange adapter are substantially the same so that the flange adapter can be positioned with either side facing up.

7. In combination, a storage tank having an access opening and a thief hatch assembly mounted over said access opening, comprising:

said storage tank having a plurality of through holes spaced around the access opening;

a flange adapter having a central opening, a bottom side and a top side, a first group of blind threaded holes formed in the flange adapter that are open to the bottom side, and a second group of blind threaded holes formed in the flange adapter that are open to the top side;

said flange adapter being positioned on said storage tank with the first group of blind threaded holes in the bottom side of the flange adapter aligned with the holes in the storage tank, and a first group of threaded fasteners extending through the holes in the storage tank into threaded engagement with the first group of blind threaded holes in the flange adapter; and a thief hatch housing with a base flange positioned on the top side of said flange adapter, said base flange having a plurality of through holes that align with the second group of blind threaded holes in said flange adapter, and a second group of threaded fasteners extending through the holes in the base flange into threaded engagement with the second group of blind threaded holes in the flange adapter;

wherein the bottom and top sides of said flange adapter are substantially the same so that the flange adapter can be positioned with either side facing up; and wherein a first pair of annular grooves are formed in the bottom side of said flange adapter, and a second pair of annular grooves are formed in the top side of said flange adapter, each of said pairs of annular grooves comprising an outer groove located radially outward of said blind holes, and an inner groove located radially inward of said blind holes.

8. The combination according to claim 7, further comprising a first seal ring configured to fit into one of said outer grooves for providing a seal between said storage tank and said flange adapter, and a second seal ring configured to fit into one of said inner grooves for providing a seal between said flange adapter and the base flange of said thief hatch housing.

* * * * *